United States Patent [19]

Kennedy

[11] Patent Number: 4,820,431

[45] **Date of Patent: * Apr. 11, 1989**

[54] RAILWAY LUBRICATING OIL

[75] Inventor: Steven Kennedy, Naperville, Ill.

[73] Assignee: Amoco Corporation, Chicago, Ill.

[ * ] Notice: The portion of the term of this patent subsequent to Mar. 29, 2005 has been disclaimed.

[21] Appl. No.: 144,249

[22] Filed: Jan. 14, 1988

Related U.S. Application Data

[63] Continuation of Ser. No. 834,605, Feb. 28, 1986, Pat. No. 4,734,211.

[51] Int. Cl.[4] ..... C10M 105/38

[52] U.S. Cl. ..... 252/56 R; 252/565; 252/5

[58] Field of Search ..... 252/56 R, 56 S, 58

[56] References Cited

U.S. PATENT DOCUMENTS

| | | | |
|---|---|---|---|
| 3,933,659 | 1/1976 | Lyle et al. | 252/42.7 |
| 4,304,678 | 12/1981 | Scheck et al. | 252/56 R |
| 4,505,829 | 3/1985 | Wisotsky | 252/56 R |
| 4,734,211 | 3/1988 | Kennedy | 252/51.5 A |

*Primary Examiner*—Jacqueline V. Howard

*Attorney, Agent, or Firm*—Matthew R. Hooper; William H. Magidson; Ralph C. Medhurst

[57] ABSTRACT

Disclosed is a lubricating oil composition for enhanced protection against silver wear in railway diesel engines which is formulated with no chlorinated hydrocarbons or with reduced levels thereof. The composition comprises a silver protective compound selected from the group consisting of (1) $C_8$ to $C_{22}$ fatty acid esters of $C_1$ to $C_{12}$ polyhydroxy alcohols or mixtures of such esters, wherein the alcohol portion of the ester has at least two unesterified hydroxyl groups; and (2) a mixture comprising the polyhydroxy compound of (1), above, and a chlorinated paraffin.

6 Claims, No Drawings

RAILWAY LUBRICATING OIL

This is a continuation of application Ser. No. 834,605 filed Feb. 28, 1986 now U.S. Pat. No. 4,734,211.

FIELD OF THIS INVENTION

This invention relates to lubricating oil compositions. More particularly, this invention relates to lubricating oils of high dispersancy-detergency and high alkalinity reserve for use as crankcase lubricant in marine and heavy duty diesel, such as railway diesel engines.

Heavy duty diesel engines require crankcase lubricant oils which are stabilized against oxidation, are non-corrosive to bearing materials including silver, and suspend combustion products which would lead to the formation of deposits in engines and formation of sludge and varnish on piston, cylinders, cylinder liners, and undercrown cavities. The diesel crankcase lubricant should prevent carbon deposition especially in the top ring piston groove. High alkalinity is required to neutralize acids formed during fuel combustion, and to reduce the frequency of oil changes. In addition, the crankcase lubricating oil for heavy duty diesel engines must be so formulated that silver parts in the engine are not attacked either by the additives in the oil or by the dispersed neutralized decomposition products produced during extended engine operation.

The present invention is directed to a new, unique combination of lubricant oil additives in a suitable base oil for heavy duty diesel engine crankcase lubrication. The diesel engine crankcase lubricant composition of this invention has demonstrated the ability to maintain a clean engine and provide increased alkalinity reserve in the used crankcase oil, while at the same time protecting silver-surfaced parts in the engine. A novel formulation of a lubricating oil has been discovered which gives superior dispersancy-detergency, and superior alkalinity reserve and protection of silver parts in railway diesel engines.

To elaborate in the background of the present invention, it has been found that railway diesel engine lubricating oil compositions having a high degree of alkalinity, that is a total base number (TBN) of at least 5, are particularly desirable in that they prevent corrosion by oil-soluble acids formed by oxidation deterioration at the high temperatures existing under normal conditions of engine operation. The term "total base number" or "TBN" is defined as the quantity of acid, expressed in terms of the equivalent number of milligrams of potassium hydroxide that is required to neutralize all basic constituents present in one gram of a given sample. The method of evaluation is described in ASTM Method D-2896. While the foregoing alkalinity can be attained by introduction into the lubricant composition of an overbased calcium phenate, the resulting lubricant compositions are generally unsatisfactory because the overbased materials tend to increase the silver wear characteristics of the lubricant composition. Railway diesel engines in large numbers in the United States and in other countries utilize silver-plated bearings.

Thus, it is an object of the invention to produce a novel, improved lubricating oil. Another object of the invention is to produce a novel lubricating oil with alkalinity reserve. Still another object of the invention is to produce a novel lubricating oil which provides superior protection to silver parts in railway engines. Other objects of the invention are to produce an extended life railway diesel engine lubricant oil which controls engine deposits, provides protection against wear, especially with high-sulfur diesel fuels and maintains an adequate alkalinity reserve under severe operating conditions. A further object of this invention is to provide a novel silver wear inhibitor not heretofore discovered by prior investigators.

DESCRIPTION OF THE PRIOR ART

Numerous diesel crankcase lubricant compositions are known. It is also known to include silver corrosion inhibitors in such compositions for use in railway diesel engine lubricant compositions. Lubricant compositions containing such silver corrosion inhibitors are taught in U.S. Pat. Nos. 4,171,269; 4,278,553; 4,169,799; 4,285,823; 4,428,850 and 4,464,276.

U.S. Pat. No. 4,171,269 teaches and claims a railway diesel engine lubricating oil composition having a TBN of at least 10 wherein the composition comprises a sulfurized normal or highly overbased calcium alkylphenolate detergent-inhibitor, a highly overbased alkaline earth metal hydrocarbyl sulfonate, a sulfurized naphthehic lubricating oil incorporating from about 1 percent to about 6 percent by weight of elementary sulfur and from 0.05 (wt.) % to 5 (wt.) % of a chloroparaffin wherein there is contained in combined form from 40 percent to 60 percent by weight of chlorine. The sulfurized naphthenic lubricating oil additive preferably contains a sulfurized lard oil formed essentially of triglycerides of $C_{12}$ to $C_{20}$ fatty acids and contaning preferably triglycerides of myristic, palmitic and stearic, oleic and linoleic in concentrations of 1, 26, 11.5, 58 and 3.5 wt. % respectively. The amount of chloroparaffin present will correlate generally with the amount of calcium sulfonate and be within the range of from 0.05 wt. % to 5 wt. % of the total lubricant composition. Silver wear properties were poor for formulations not containing both the chloroparaffin additive and the sulfurized naphthenic oil.

U.S. Pat. No. 4,278,553 teaches and claims a railway diesel engine lubricant containing a silver corrosion inhibitor comprising a benzotriazole compound present in concentrations from about 0.5 to 2.0 weight percent. Examples of silver corrosion inhibitors include benzotriazole derivatives of N-alkyl-1,3-propanediamines.

U.S. Pat. No. 4,169,799 discloses a combination of components consisting of an overbased alkaline earth metal containing alkyl phenolate sufficient to impart a TBN of at least 10 alkylphenol and a chlorinated sulfurized alkylphenol in a mineral oil base stock. The chlorinated alkylphenol is present in an amount of from 0.25 to 20 weight percent.

U.S. Pat. No. 4,285,823 discloses a silver corrosion inhibitor for railway diesel engines lubricants comprising an N-alkylaminomethyl-5-amino-1H-tetrazole. The diesel lubricant contains the additive in an amount of from 0.5 to 2.0 weight percent. Silver corrosion inhibiting characteristics are measured by scars caused by a rotating steel ball positioned on silver disks.

Use of chlorinated hydrocarbons as silver wear inhibitors in railway diesel engine oils are also taught in U.S. Pat. Nos. 4,320,016; 4,428,850 and 4,464,276.

In the above-mentioned patents, particularly useful lubricant compositions as railway diesel engine lubricants are those containing substantially normal and/or highly overbased alkaline earth metal sulfurized alkylphenolate and highly overbased alkaline earth metal sulfonate additives having a TBN of at least 10 and thus capable of preventing corrosion by oil-soluble acids formed by oxidiative deterioration under normal engine use. If a sulfurized naphthenic oil-containing composition having a sufficient sulfur content is present with the foregoing overbased additives, the corrosion of the silver-plated bearings by the overbased alkaline earth metal alkylphenolate is overcome but not the similarly desctructive properties of the alkaline earth metal sulfonate. Nevertheless, the incorporation of an alkaline earth metal sulfonate in these lubricant oils is desirable because of the improved engine performance provided over an extended period of time.

As already noted, chlorinated hydrocarbons have been incorporated into railway diesel engine lubricant compositions to provide silver protection properties to the lubricant compositions. However, environmental aspects of incorporating quantities of chlorinated hydrocarbons into railway diesel engine lubricants indicate that reduced use of chlorinated compounds and use of non-chlorinated compounds to provide silver protective properties is preferable.

In accordance with this invention, there is provided a diesel engine lubricating oil composition comprising a diesel engine lubricating oil of lubricating viscosity, a silver wear inhibitor comprising essentially a polyhydroxy compound or an amount of said polyhydroxy compound and a lesser amount of a chlorinated hydrocarbon wherein the polyhydroxy compound is selected from the group consisting of $C_8$ to $C_{22}$ fatty esters of alcohols of from 1 to 12 carbon atoms having at least two hydroxyl groups, and mixtures thereof said esters, a dispersant comprising an alkyl Mannich derivative of a polyamine, a highly overbased alkaline earth metal alkylphenolate, a calcium Mannich phenate oxidation inhibitor, and a neutralized alkaline earth metal hydrocarbyl sulfonate wherein the lubricant composition has a TBN of at least 5 and silver wear inhibiting properties provided by a non-chlorinated silver wear inhibitor.

Free hydroxyl groups of partial esters such as of glycerol monooleate and pentaerythritol monooleate are known in the prior art to promote corrosion of sensitive bearing materials. For example, U.S. Pat. No. 2,898,299 teaches that free hydroxyl groups in these partial esters act at elevated temperatures to promote corrosion of bearing metals such as copper-lead, cadmium-silver, cadmiumnickel, the co-called high lead bearing alloys and the like. Thus, it is indeed surprising and unexpected that polyhydroxyl compounds such as glycerol monooleate, pentaerythritol monooleate and like polyhydroxy compounds can act as wear inhibitors of silver and silver-plated bearing materials at temperatures existing in a railway diesel engine under normal operating conditions in the lubricant composition of the present invention.

SUMMARY OF THE INVENTION

A railway diesel engine lubricant composition containing a non-chlorinated silver wear inhibitor is disclosed which gives superior dispersancy-detergency, and superior alkalinity reserve and protection of silver parts in railway diesel engines.

DETAILS OF THE INVENTION

The present invention provides a lubricating oil composition of a TBN of at least 5 containing an additive amount, sufficient to provide silver wear inhibition in an internal combustion engine, of a polyhydroxy compound. Examples can be selected from the group consisting of $C_8$ to $C_{22}$ fatty acid esters of glycerol, and pentaerythritol monooleate, sorbitan monooleate, pentaerythritol dioleate, pentaerythritol tetraoleate, sorbitan trioleate, and mixture thereof, among others. Preferred fatty acid esters of glycerol are glycerol monooleate and glycerol dioleate. Other suitable fatty acid esters of glycerol which can be used include glycerol tallate, glycerol laurate, glycerol palmate, glycerol linoleate, glycerol linolenate, and glycerol ricinoleate, among others. The lubricating oil composition can be a mineral lubricating oil or a synthetic ester lubricating oil. The silver wear inhibitor additive can be present in the lubricating oil composition in a range of from about 0.01% to about 3.0% by weight.

The present invention also provides a lubricating oil composition of a TBN of at least 5 comprising (a) a major amount of a lubricating oil, (b) from 1% to about 10% by weight of an ashless dispersant compound selected from the group consisting of Mannich base dispersants prepared from the reaction of alkylphenols, formaldehyde and amines, succinimide dispersants prepared as condensation products between alkenyl succinic anhydrides and amines, succinate ester dispersants and succinate ester amide dispersants, (c) from about 0.1% to about 20.0% by weight alkaline earth metal compositions to provide alkalinity reserve, oxidation inhibition and detergency to the lubricating oil composition, said earth metal compositions selected from the group consisting of calcium alkylsulfonates, magnesium alkyl sulfonates, sodium alkyl sulfonates, calcium alkylphenolates, magnesium alkylphenolates, calcium alkylsalicyclates, magnesium alkylsalicylates, and mixtures thereof, and d) an additive in an amount sufficient to provide silver wear inhibition in an internal combustion engine wherein said additive is selected from the group consisting of a polyhydroxy compound containing from 5 to about 60 carbon atoms, a mixture of said polyhydroxy compond and chlorinated hydrocarbons, and a mixture of said polyhydroxy compound and chlorinated $C_8$ to $C_{22}$ fatty acids. Derivatives of the chlorinated $C_8$ to $C_{22}$ fatty acids can also be used in the mixtures so long as the silver wear activity of the additive is not affected. These derivatives include esters and amines derived from alcohols and amines of from one to 60 carbon atoms. The amount of the silver wear inhibitor present can be from about 0.01% to about 3.0% by weight of the lubricating oil composition.

The present invention also provides a lubricating oil composition of TBN of at least 5 which comprises:

(1) A major amount of a lubricating base oil.

(2) From 1 to 10 (wt.) % of an ashless dispersant compound.

(3) From 0.1 to 10.0 parts by weight of basic of overbased alkaline earth metal alkylphenolate.

(4) From 0.1 to 10.0 parts by weight of an alkaline earth metal alkyl sulfonate and (5) From 0.1 to 10.0 parts by weight of an alkaline earth metal Mannich phenolate and characterized in that the lubricant oil composition contains from 0.01 to about 3.0 (wt.) percent of a silver wear inhibitor selected from the group consisting of a polyhydroxy compound containing from 5 to about 60 carbon atoms or a mixture of said polyhydroxy compound and a chlorinated hydrocarbon wherein said chlorinated hydrocarbon is present in a lesser amount than the polyhydroxy compound.

The compositions disclosed are improved lubricant compositions comprising (A) a lubricant base oil, which can be a mineral base oil or a synthetic ester base oil, (B) a Mannich condensation reaction product comprising the reaction product of an alkyl phenol, a polyamine and formadehyde, (C) an alkaline earth metal salt of a Mannich condensation reaction product comprising the reaction product of an alkyl phenol, formaldehyde, and a polyamine, (D) an alkyl benzene sulfonate of an alkaline earth metal having a total base number of at least 1, (E) an overbased alkaline earth metal phenolate, (F) a polyhydroxy compound, or a polyhydroxy compound and a chlorinated compound, and (G) a small amount of a polydimethyl siloxane.

The composition of the lubricant oil can contain a mineral base oil. The composition can also contain a blend of lubricant oils having viscosities such that the final viscosity at 100° C. of the lubricating oil composition is in the range of about 12.0 to about 17.0 cSt. The composition of the lubricant oil can contain the alkyl phenol Mannich condensation product wherein the alkyl moiety is derived from a polyalkene selected from the group consisting of polyethylene, polybutene, and polypropene, the molecular weight of which is in the range of about 500 to about 30,000. The compositions of the lubricant oil can contain a calcium salt of an alkyl phenol Mannich condensation reaction product wherein the alkyl moiety has from 6 to about 12 carbon atoms. The compositions of the lubricant oil can contain a calcium overbased alkyl benzene sulfonate where the alkyl moiety of the alkyl benzene sulfonic acid is selected from the group consisting of groups derived from polyethylene, polybutene and polypropene whose molecular weights are in the range of about 400 to about 900. The composition can also contain a calcium salt of a sulfurized alkyl phenolate wherein the alkyl moiety has from about 6 to about 12 carbon atoms. The composition of the lubricant oil can contain a polyhydroxy of from 5 to 60 carbon atoms or a mixture of said polyhydroxy compound and a chlorinated paraffin which is from about 20 to about 70 weight percent chlorine and a molecular weight of from about 350 to 1100. A composition of the lubricating oil can have a dimethyl siloxane polymer having a viscosity at about 77° F. from about 300 to about 30,000 centistrokes.

The improved lubricant composition accordingly comprises (A) a lubricant base oil stock; (B) about 1.0 to about 10.0 weight percent of the Mannich condensation product which comprises the reaction product of polybutyl phenol wherein the polybutyl moiety is from about 500 to about 30,000 molecular weight and formaldhyde and tetraethylene pentamine; (C) from about 1.0 to about 10.0 weight percent of the calcium salt of Mannich condensation product which comprises the reaction product of a nonyl phenol, formaldehyde and ethylene diamine; (D) about 0.1 to about 10.0 weight percent low base number overbased alkaline earth metal salt of the polypropyl benzene sulfonic acid wherein the polypropyl moiety has a molecular weight from about 400 to about 600; (E) about 0.1 to about 10.0 weight percent of the overbased sulfurized calcium alkyl phenate; (F) from about 0.01 to about 3.0 weight percent of a polyhydroxy compund of from 5 to 60 carbon atoms or a mixture of said polyhydroxy compound and a chlorinated paraffin which contains 20 to 70 weight percent chlorine; (G) from about 2.5 to about 25 parts per million, based on a lubricant oil, of a dimethyl siloxane polymer whose viscosity at 77° F. is from about 10,000 to about 13,000 centistokes.

The improved lubricating oil composition can be produced by suspending or dissolving in the base oil the various additives. The suitable base lubricant mineral oil is selected to conform to viscosity requirements. Either a single base oil or blends of different viscosity base oils may be used as the base for the additive lubricant oil. The components may be blended in any order and in any combination. The first component of the improved lubricant composition is the Mannich condensation reaction product which comprises the reaction product of a polyalkyl phenol, a polyamine and formaldehyde. The alkyl phenol is commonly a high molecular weight alkyl-substituted hydroxy aromatic compound such as polypropyl phenol, polybutyl phenol or other alkyl phenols. These alkyl phenols may be obtained by the alkylation of phenol in the presence of an alkylating catalyst such as $BF_3$—HF, $BF_3$ or $AlCl_3$ with high molecular weight polypropylene, polybutylene or other polyalkene compounds to give alkyl substituents on the benzene ring of the phenol having a number average molecular weight of 600 to 100,000. These alkyl substituted hydroxy aromatic compounds may be derived from polypropenes, polybutenes and other polymers of monoolefins, principally 1-butene, 2-butene, isobutene and propene. Also, monomers may be copolymerized with propene or butene and other chlorinated, brominated or other derivatives of monoalkene compounds. Mannich condensation reaction products disclosed herein may also contain boron in many forms. The Mannich products may also contain fatty acids. The boron and fatty acid compounds are believed to promote ease of production of the additives. The boron and fatty acids also increase the detergency, dispersancy, and deposit preventing properties of the Mannich additives. Fatty acids such as oleic, linoleic, stearic, and other $C_{16}$ to $C_{24}$ acids are commonly useable. Boron is generally introduced in the form of superborate salts, borate salts, or boric acid.

Preferably, the configuration of the alkyl substituted hydroxy aromatic compound is that of para-alkyl phenol. However, other alkyl phenols are relatively reactive and thus useful in the Mannich condensation product.

Representative amine reactants are alkane polyamine, principally, polyethylene polyamines. The polyamines which may be used are ethylamine, diethyl amine, dimethyl amine or propyl amine and diethylol amine; ethylene diamine, diethylene triamine, triethylene tetraamine, triethylene pentamine, pentaethylene hexamine, hexethylene heptamine and mixtures of the amines, including polypropylene polyamines, having nitrogen content corresponding to the alkylene polyamines of which the formula $NH_2[(CH_2)_xNH—9_y$ is representative. X is a number from 2 through 4, and y is a number from 1 through 6.

Representative aldehydes for use in the preparation of the high molecular weight products of this invention include aliphatic aldehydes such as formaldehyde, including paraformaldehyde and formalin, acetaldehyde and aldol (betahydroxybutyraldehyde). Preferably a formaldehyde or a formaldehyde-yielding reactant is used.

Another component of the formulation of the improved lubricant oil are low or high base number alkylbenzene sulfonates. These overbased alkyl sulfonates are produced from alkylated benzene sulfonic acids.

These alkylated benzene sulfonic acids are generally produced by sulfonating benzene alkylates. The broad class of benzene alkylates include such compounds as polypropyl benzene, poly 1-butylbenzene, poly isobutylbenzene, poly 2-butylbenzene, polyethylene benzene and copolymers of propyl and 1-butyl benzene and other various copolymers of ethene, propene and butene isomers. The preferred alkyl benzenes are polypropyl, polybutyl and copolymer propyl 1-butyl benzenes. Especially preferred as polypropyl benzenes wherein the alkyl moiety has a number average molecular weight of from about 400 to about 900. The alkaline metal oxide which is used to overbase the alkyl sulfonic acids may be chosen from a group consisting of barium oxide, calcium oxide, magnesium oxide or other Group I and Group II metal bases. Preferably, the overbased sulfonic acids are produced from calcium oxide. The alkyl benzenes are commonly sufonated with fuming sulfuric acid or oleum, in standard industrial sulfonation procedures. The sulfonate is overbased when the sulfonate contains more base than is needed to neutralize the sulfonic acid. Degrees of overbasing are measured in the form of Total Base Number (TBN) by ASTM Test D-2896. Total base number is equivalent to the milligrams of KOH equivalent to the amount of base in the composition which exceeds the amount needed to neutralize the sulfonic acids. TBN's of 1 to 400 are common.

Another component of the formulation is the alkaline earth salt of an alkyl phenol, formaldehyde, polyamine Mannich condensation reaction product. Phenols which have utility in this application are alkylated phenols such as methyl, ethyl, propyl, butyl, pentyl, hexyl, heptyl, octyl, nonyl decyl, undecyl, dodecyl phenol and the like. Also useful are alkylated phenols such as polyalkyl phenols formed from polyalkenes and phenol. Formaldehyde may be in the form of paraformaldehyde, formaline, or other well known formaldehyde generating reactants. Polyamines such as ethylene diamine, diethylene triamine, and tetraethylene pentamine find utility in this product. The Mannich condensation reaction product is overbased using an alkaline earth metal such as calcium, barium or magnesium to total base numbers of from about 1 to 170. The metal may be in the form of oxides or hydroxides or carbonate.

The alkaline earth metal salt of a alkyl phenate sulfide is used as an alkalinity agent and detergent. Alkylphenols such as dodecyl, undecyl, decyl, nonyl, actyl and other phenols which are alkylated by groups formed from polyalkenes commonly are used. The alkyl phenols react with an alkaline earth metal such as calcium or magnesium to form the alkaline earth metal salt of an alkyl phenate. Total base numbers from about 1 to about 300 may be attained.

The polyhydroxy esters in the oil compositions of my invention are the higher polyhydric aliphatic alcohols partically esterified with an aliphatic carboxylic acid having an oil-solubilizing chain of at least 8 carbon atoms. Since the effectiveness of the esters to inhibit wear of the silver components of the diesel in engines depends at least in part upon unesterified hydroxyl groups, it is preferred that at least two, and most desirably all but one, of the hydroxyl groups remain unesterified. For appreciable effectiveness as a silver wear inhibitor additive, the alcohol should contain at least three, preferably four or five, and including six hydroxyl groups. Suitable alcohols of from 2 to 12 carbon atoms having at least two hydroxyl groups which may be employed in forming the esters are exemplified by glycerol, tetrahydric alcohols such as erythritol, pentaerythritol, etc., the pentahydric alcohols such as penitol, tetramethylol cyclohexanol, etc., hexahydric alcohols such as sorbitol, manitol, inositol, etc., ether alcohols including polyglycols such as diethylene glycol, polypentaerythritols such as dipentaerythritol, etc., anhydro alcohols such as sorbitan, mannitan, etc., derivatives of anhydro alcohols such as the polyoxyalkylene derivatives of sorbitan and mannitan, and the like. For some uses, the tetra- or higher poly-hydric alcohols are preferred.

It should be noted that when glycerol, for example, is esterified with a fatty acid, mono-, di- and triesters form. Commercial glycerol monooleate, for example, contains a large amount of dioleate and a minor amount of trioleate. Mono-, di- and triesters and mixtures thereof are contemplated for use in this invention. When, for sake of convenience, the term "glycerol monooleate" is used, the di- and trioleates are included within the meaning of glycerol monooleate.

Representative higher aliphatic carboxylic acids which can be employed to form the above-described esters include capric, undecyclic, lauric, myristic, palmitic, stearic, arachidic, behenic, and melissic as well as the higher naphthenic acids and naphthenic acid mixtures of the type derived from petroleum. Also, mixtures of acids derived from natural sources such as coconut oil, lard oil, tallow, cottonseed oil, soybean oil and palm oil can be used. Among the higher aliphatic acids, a preferred group comprises those containing 10 or more carbon atoms and a single olefinic carbon-to-carbon double bond, as exemplified by 9-undecylenic, 4-tetradecylenic, oleic, palmitroleic, ricinioleic, elaidic and brassidic acids.

While the acids and alcohols employed in forming the esters of the present invention have been referred to as "aliphatic" in character, such term is also intended to include acids of the type defined above which are substituted by one or more of various groups such as amino, hydroxyl, alkoxy, chloro, phenyl, and the like, particularly when the number, nature and position of such substituent groups is not sufficient to alter the essentially aliphatic character and stability under the selected conditions of use of the ester. The term also includes higher cyclic aliphatic acids and alcohols as exemplified, respectively, by the naphthenic acids, and sorbitan.

Of the various partial esters indicated above, the monooleates of pentaerythritoal and glycerol are preferred for their outstanding effectiveness as silver wear inhibitors.

The esters of the above-disclosed alcohols and acids can be present in the base oil in amounts ranging up to about 2 or 3%, although in most cases they are present in amounts of less than 1%. While some esters appear to have limited solubilities in very light mineral oils, they are readily soluble up to 12 to 20% or more in oils normally used as lubricants. Usually the esters can be dispersed in amount greater than their apparent solubility limits.

In the event a mixture of a polyhydroxy compound and a chlorinated paraffin is utilized as a silver wear inhibitor additive package, the inhibitor combination package is incorporated with the lubricant oil composition in sufficient amount to inhibit substantially against wear of bearing surfaces.

A small amount of a silicone anti-foam agent commonly used in the art is also incorporated in the formulation. In general terms this is a polydimethyl siloxane. The typical properties of the preferred polymer, at 77° F., are viscosity in the range of about 10 to 100,000 centistokes, pour point is about 40° F. to 60° F., specific gravity is about 0.900 to about 0.995 and each of these blends of silicone fluids contains a broad range of molecular weights.

The present invention is further illustrated by the following examples which are not, however, to be construed as limitations thereof. In these examples, as in the remainder of the specification, all references to "parts" or "percentages" are references to parts or percentages by weight unless otherwise specifically indicated. Active components of the individual additives, unless otherwise indicated, are in the range of from about 40 (wt.) % to about 50 (wt.) % of the total weight of the additive formulation. The silver wear inhibitor compounds, i.e., the polyhydroxy compounds, the chlorinated compounds and mixtures thereof, are on the basis of active components.

In the finished lubricating oil composition, other additives may be includes as supplementary dispersants, supplementary silver wear inhibitors including thiadiazoles, benzotriazoles, and other sulfur containing silver wear inhibitors, pour depressors, antioxidants, viscosity index improvers, oleogenous agents, antifoam agents and mixtures thereof.

EXAMPLE I

Preparation of Mannich condensation product.

A stirred reactor is charged with 0.4 moles of nonylphenol over a period of 7 hours, about 1 mole of boron trifluoride, $BF_3$, is blown into the phenol while maintaining the temperature below 175° F. The resultant $BF_3$ complex has a boron content of about 1 percent. 100 gms, of the $BF_3$-nonyl phenol complex is added to 1100 gms. of polybutene having an average molecular weight of about 900, diluted with solvent-extracted 5W oil, with stirring, at about 100° to 125° F. for about an hour, the reaction mass is neutralized. The reaction mass is then heated to about 500° F. while excess volatiles are stripped therefrom with inert gas. The polybutyl phenol amine condensation reaction product is prepared by charging the stirred reactor with 1200 gms. of the polybutyl phenol produced in the preceding step, together with 775 gms. of tetraethylene pentamine and the temperature is adjusted to 80° F. or less. Then there is added 710 gms formaldehyde. After formaldehyde addition, the reaction mixture is rapidly heated to about 320° F. while blowing with an inert gas to remove and other volatiles. The stripped reaction mixture is then filtered and the filtrate is diluted with mineral oil to 40% active component and is ready for use.

EXAMPLE II

Preparation of calcium salt of Mannich reaction product 8.0 moles of nonyl phenol in a diluent oil were added to a flask under a nitrogen blanket. 4.0 moles of ethylene diamine were added to the flask. 7.0 moles of formaldehyde were added at a rate to keep the flask below 300° F. The mixture was heated to 300° F. for one hour. The mixture was cooled. Antifoam agents and diluent oil were added. 3.0 moles of calcium hydroxide in 400 milliliters of diluent oil were added to the mixture. The reaction mixture was heated to 190° F. for one hour, then heated to 300° F. to remove water and blown with nitrogen. The mixture was cooled and filtered to a clear product which contained about 50% diluent oil. The TBN was approximately 160.

EXAMPLE III

Preparation of Sulfonate 1.070 grams of benzene is charged into a reaction vessel and heated with steam. 17.4 grams of aluminum chloride is slowly added to the benzene and the mixture is stirred until a complex agent reaction mixture is completed, approximately a half hour. Into this mixture is mixed 870 grams of a polypropylene which has a molecular weight of from about 400 to about 600. The polypropylene is added at a rate so that the addition is completed in about 20 minutes. At the end of the addition, the reaction is continued for another 20 minutes. At the end of this time the mixture is heated to approximately 250° F. and is blown with nitrogen or steam to remove benzene, unreacted polyumer, and light alkylates. The heavy alkylate is recovered. Approximately 720 grams of polymer alkylate is produced. The sulfonation of the alkylate is done by mixing in a jacketed vessel the alkylate and approximately an equal amount of 22 percent oleum over a time period of about 1.5 hours. During this mixing step the temperature of the mixture is not allowed to exceed 95° F. Upon completion of the mixing, the mixture is allowed to react for approximately 1 hour at a temperature not greater than 130° F. At the end of this time the mixture is diluted with 250 grams of water to form a concentration of sulfuric acid in the aqueous layer of less than 85 percent. The mixture is allowed to settle and separate into a lower sulfuric acid layer and an upper sulfonic acid product. The separation is substantially complete in approximately 20 minutes. To prepare the calcium overbased sulfonate, in a reaction vessel is placed 1.38 of mols of sulfonic acid, 300 ml. of xylene, 929 mols of calcium oxide and 24.7 mols of methanol. Into this mixture at 30° F. is bubbled carbon dioxide and ammonia. This carbonation is continued for approximately 1 hour. At the end of this time, the temperature of the reaction vessel is increased to 250° F. and the reaction mixture is blown with an inert gas to remove the xylene, the methanol and unreacted carbon dioxide and ammonia. The mixture is filtered and the overbased calcium sulfonate is recovered. The product is used as a mixture containing 60% mineral oil. Overbasing technology is well known and variation in base number are readily achieved.

EXAMPLE IV

Preparation of Calcium phenate

To a 5 liter flask fitted with a stirrer and Dean Stark trap was added the following:

| Component | Grams | Moles |
|---|---|---|
| Nonylphenol | 157 | 0.71 |
| Dodecylphenol | 784 | 2.99 |
| SX-5W Oil | 886 | (239 g/mole phenols) |
| Calcium Hydroxide | 184 | 2.49 |
| Sulfur | 129 | 4.03 |

The mass was heated to 360° F. and held there for 2 hours and then allowed to cool. Into this mixture at 80° F. is bubbled carbon dioxide and ammonia. The carbonation is continued for approximately 1 hour. At the end of this time, the temperature of the reaction vessel is increased to 250° F. and the reaction mixture is blown with an inert gas to remove the volatiles. The mixture is filtered and the overbased calcium phenate, which contains about 55% diluent oil, is recovered. The TBN was 120. Overbasing technology is well known and variation in base number readily achieved.

EXAMPLE V

Eleven samples of formulations containing silver wear inhibitors were tested in what is known to those skilled in the art as the Amoco modified Silver Disc Wear Test. The formulations were typical lubricant additive compositions containing a Mannich dispersant, a calcium Mannich salt, a calcium sulfonate, a calcium phenate, a silicone antifoam polymer and base oil. The formulations were identical except for the supplemental silver wear inhibitors. This wear test procedures is a laboratory test for determining the anti-wear properties of a lubricant oil. The test machine comprises a system wherein a one-half inch diameter 52100 steel ball is placed in assembly with three one-quarter inch silver discs of like size and of a quantity identical to that employed in the plating of the silver pin insert bearing or railway diesel engines manufactured by the Electromotive Division (EMD) of General Motors, Inc. These discs are in a fixed triangular position in a reservoir containing the oil sample to be tested for its silver anti-wear properties. The steel ball is positioned above and in contact with the three silver discs. In carrying out these tests, the ball is rotated while it is pressed against the three discs at the pressure specified and by means of a suitable weight applied to a lever arm. The test results are determined by using a low power microscope to examine and measure the scars on the discs. A wear scar diamater of 2.2 mm or less is considered to indicate adequate silver wear protection. The rotation of the steel ball on the silver discs proceeds for a period of 30 minutes at 600 revolutions per minutes under a 23 kilogram static load. Each oil was tested at 500° F.

The Results of the tests are shown in Table I.

TABLE I

| Silver Disk Wear Test - Glycerol Monooleate | | | | | |
|---|---|---|---|---|---|
| Inhibitor | Silver Wear Scars (mm) | | | | |
| Chlorinated Hydrocarbon (wt.) % (Chlorowax-170) | 0.00 (mm) | 0.025 (mm) | 0.06 (mm) | 0.13 (mm) | 0.25 (mm) |
| | 2.5 | 2.3 | 2.3 | | 2.1 |
| | 2.7 | 2.3 | 2.4 | | 2.1 |
| | 2.7 | 2.4 | | | |
| | 2.9 | | | | |
| With added glycerol monooleate (GMO) (wt.) % | | | | | |
| 0.10 | | 2.2 | 2.1 | 2.1 | |
| | | 2.3 | 2.2 | 2.3 | |
| 0.25 | 2.1 | 2.0 | 2.3 | | |
| | | 2.1 | | | |
| 1.00 | 2.0 | | | | |
| | 2.1 | | | | |

Note: Clorowax 170 (Keil Chemical Div., Ferro Corp. Hammond, Ind.)

In the absence of a silver wear inhibitor, silver disk wear scars were 2.5 to 2.9 mm in diameter. After addition of 0.25 (wt.) % of a chlorinated hydrocarbon silver wear inhibitor, silver disks were scars were 2.1 mm. The addition of 0.10 (wt.) % glycerol monooleate to a formulation containing 0.06 (wt.) % chlorinated hydrocarbon resulted in a reduction of the wear scar to 2.1 and 2.2 mm diameter. A formulation containing 1.00 (wt. %) glycerol monooleate in the absence of chlorinated hydrocarbon resulted in wear scars of 2.0 and 2.1 mm diameter.

EXAMPLE VI

The procedure of Example V was repeated with pentaerylthritol monooleate as a silver wear inhibitor. Results are in Table II.

TABLE II

| Silver Disk Wear Test - PEMO | | | |
|---|---|---|---|
| Inhibitor | Silver Wear Scars (mm) | | |
| Chlorinated Hydrocarbon (wt.) % (Chlorowax-170) | 0.00 (mm) | 0.06 (mm) | 0.25 (mm) |
| | 2.7 | 2.0 | 2.0 |
| With added pentaerythritol monooleate (PEMO) (wt.) % | | | |
| 0.10 | 2.4 | 1.9 | |
| 1.00 | 1.9 | | 1.8 |

The data in Table II indicate that 1 (wt.) % pentacrythritol reduces silver wear scar more than does 0.25 (wt.) %. Chlorowax 170 is a commerical silver wear inhibitor (Keil Chemical Div. Ferro Corp.).

Table II also indicates that addition of pentaerythritol monooleate to a chlorinated hydrocarbon improves the wear inhibiting performance of the chlorinated hydrocarbon.

EXAMPLE VII

Six samples of lubricating oil compositions were prepared and tested in the EMD 2-567 silver wear test. The EMD 2-567 test is a well-known test in which a diesel engine, a two cylinder (1134 CID) segment of a naturally aspirated railroad diesel engine, is run for 25 hours. Wear is measured on the silver connecting rod bearing inserts. SAE 40 grade oils only are used. Wear is measured in demerits. An average of 50 or less demerits with neither of the two bearings having 50 or more demerits is considered a passing result.

Table III summarizes EMD test results obtained with four railway diesel oils (RRD) containing CW-170, pentaerythritol monooleate or a combination of glycerol monooleated and a chlorinated additive. The first test oil, A, contains 0.50% CW-170 for controlling silver wear. This oil gave a passing result with an average of 14.8 demerits. An oil with 0.50% PEMO as the only silver wear passivator, B, gave a passing result. This test indicated that PEMO was indeed protecting against excessive silver wear. The additional tests, C and D, were run with a combination of GMO and chlorinated inhibitor. Test C contained 0.50% GMO and 0.09% CW-170 and Test D had 0.40% GMO and 0.09% CW-80-E which is a chlorinated fatty compound containing 33 (wt.) % chlorine. Both oils performed very well in passing the EMD test. These engine test data demonstrate that GMO and PEMO do function as silver wear inhibitors in railway diesel oils (RRD) as predicted by bench testing.

TABLE III

| EMD Engine Test Results With Glycerol Monooleate | | | | |
|---|---|---|---|---|
| Sample No. | A | B | C | D |
| Dispersant-Inhibitor Package | 12.00 | 12.00 | 12.00 | 12.00 |
| CW-170 | 0.50 | | 0.09 | |
| CW-80-E | | | | 0.09 |
| GMO | | | 0.50 | 0.40 |

TABLE III-continued

| Sample No. | EMD Engine Test Results With Glycerol Monooleate A | B | C | D |
|---|---|---|---|---|
| PEMO | | 0.50 | | |
| Base Oil | Balance | Balance | Balance | Balance |
| Demerits | | | | |
| Left | 17.5 | 34.5 | 7.5 | 31.3 |
| Right | 12.0 | 28.0 | 25.5 | 14.5 |
| Average | 14.8 | 31.3 | 16.5 | 22.9 |

Note: Dispersant-inhibitor package contained Mannich dispersant, calcium Mannich salt, sulfurized calcium phenate, calcium sulfonate, and a silicone antifoam polymer.

The silver wear inhibitors of the instant invention have no adverse effect on oil performance in oil thickening experiments. This oil thickening test is run by placing 100 grams of a test oil and polished lead and copper coupons in a test tube. The test tube is then sparged with air and held at 320° F. for duration of the test. Samples of the test oil are evaluated for viscosity increase relative to the original test oil. Results are reported as a percentage viscosity increase. The lower the percent viscosity increase, the better is the oil thickening test (OTT) performance.

Commerical chlorinated silver wear inhibitors, such as CW-170 and CW-80-E, have been shown to accelerate thickening of railway diesel oils exposed to oxygen and solid metal catalysts (copper and lead) at temperatures of 285° F. and above. Additives such as GMO and PEMO have been shown to have no adverse effect on oil performance in oil thickening tests.

Table IV summarizes the results of two sets of bench oxidation experiments. Each oil contains the same basic dispersant-inhibitor (DI) package. One or more supplemental silver wear inhibitor is then added to the oil. This test measures the viscosity increase of the oil after the 48 hours of the experiment. Lower percent viscosity increases indicate better bench test performance data from these experiments show that addition of CW-80-E to the baseline oil produces oils that thicken more than the baseline. Addition of GMO to oils with or without CW-80-E has essentially no effect on the thickening of the oil.

TABLE IV

| Oil Thickening Tests of RRD Oils | | | | |
|---|---|---|---|---|
| DI Package (a) | 10.90 | 10.90 | 10.90 | 10.90 |
| CW-80-E | — | 0.50 | — | 0.50 |
| GMO | — | — | 0.50 | 0.50 |
| Base Oil | Balance | Balance | Balance | Balance |
| OTT Results (b) | | | | |
| Trial 1 | | | | |
| Viscosity (cSt, 40° C.) | | | | |
| Initial | 185.4 | 184.2 | 195.2 | 184.8 |
| After 48 hours | 223.8 | 269.5 | 211.2 | 281.1 |
| % Vis. Increase | 21 | 46 | 14 | 52 |
| Trial 2 | | | | |
| Viscosity (cSt, 40° C.) | | | | |
| Initial | 185.4 | 194.2 | 195.2 | 194.8 |
| After 48 hours | 231.7 | 292.2 | 226.5 | 300.7 |
| % Vis. Increase | 25 | 59 | 22 | 63 |

(a) DI package contains Mannich dispersant, calcium Mannich salt, sulfurized calcium phenate, and calcium phenate.
(b) Conditions 320° F., air 60 cc/min, 48 hr., start with 100 g of test oil

What is claimed is:

1. A method for reducing silver wear in marine and railway diesel engines which comprises the step of lubricating the internal portion thereof with a lubricating oil composition having a TBN of at least 5 and comprising a silver protective compound selected from the group consisting of (1) $C_8$ to $C_{22}$ fatty acid esters of $C_1$ to $C_{12}$ polyhydroxy alcohols or mixtures of such esters, wherein the alcohol portion of the ester has at least two unesterified hydroxyl groups; and (2) a mixture comprising the polyhydroxy compound of (1), above, and a chlorinated paraffin.

2. The method of claim 1 wherein the lubricating oil is a mineral oil.

3. The method of claim 1 wherein the lubricating oil is a synthetic ester oil.

4. The method of claim 1 wherein the silver protective compound comprises glycerol monooleate and is essentially free of said chlorinated paraffin.

5. The method of claim 1 wherein the silver protective compound comprises pentaerythritol monooleate and is essentially free of said chlorinated paraffin.

6. The method of claim 1 wherein the silver protective compound comprises said chlorinated paraffin in combination with a polyhydroxy compound selected from the group consisting of glycerol monooleate or pentaerythritol monooleate or mixtures thereof.

* * * * *